United States Patent [19]

Cunningham et al.

[11] 4,218,962

[45] Aug. 26, 1980

[54] APPARATUS FOR FORMING THERMAL INSULATION BLOCKS

[75] Inventors: Richard N. Cunningham; Douglas D. Smith, both of Littleton, Colo.

[73] Assignee: Johns-Manville Corporation, Denver, Colo.

[21] Appl. No.: 921,682

[22] Filed: Jul. 3, 1978

[51] Int. Cl.[2] ..... E04B 1/80

[52] U.S. Cl. ..... 93/84 R; 29/798; 52/509; 53/117; 227/65; 270/79

[58] Field of Search ..... 93/84 R; 270/39, 79; 52/509; 29/798, 432.1; 227/65; 53/117

[56] References Cited

U.S. PATENT DOCUMENTS

| | | | |
|---|---|---|---|
| 980,385 | 1/1911 | Wollheim | 270/79 |
| 1,290,800 | 1/1919 | Teall | 270/79 X |
| 1,290,801 | 1/1919 | Teall | 270/39 |
| 1,881,814 | 10/1932 | Meglitz et al. | 270/79 |
| 2,101,906 | 12/1937 | Hopkinson | 270/79 X |
| 2,216,655 | 10/1940 | Smith et al. | 270/79 |
| 3,952,470 | 4/1976 | Byrd | 52/509 |
| 4,001,996 | 1/1977 | Byrd | 52/509 |
| 4,130,936 | 12/1978 | Cottrell | 29/79 B X |

*Primary Examiner*—Robert D. Baldwin

*Attorney, Agent, or Firm*—Robert M. Krone; Joseph J. Kelly; James W. McClain

[57] ABSTRACT

Apparatus is described for the formation of thermal insulation blocks from rolls of fibrous blankets. The apparatus comprises folding means to make alternating transverse folds in the blanket, insertion means to insert block supporting members (pronged beams) into and through folds of the block, and sequencing means to control the location of beam insertion according to a predetermined pattern.

11 Claims, 25 Drawing Figures

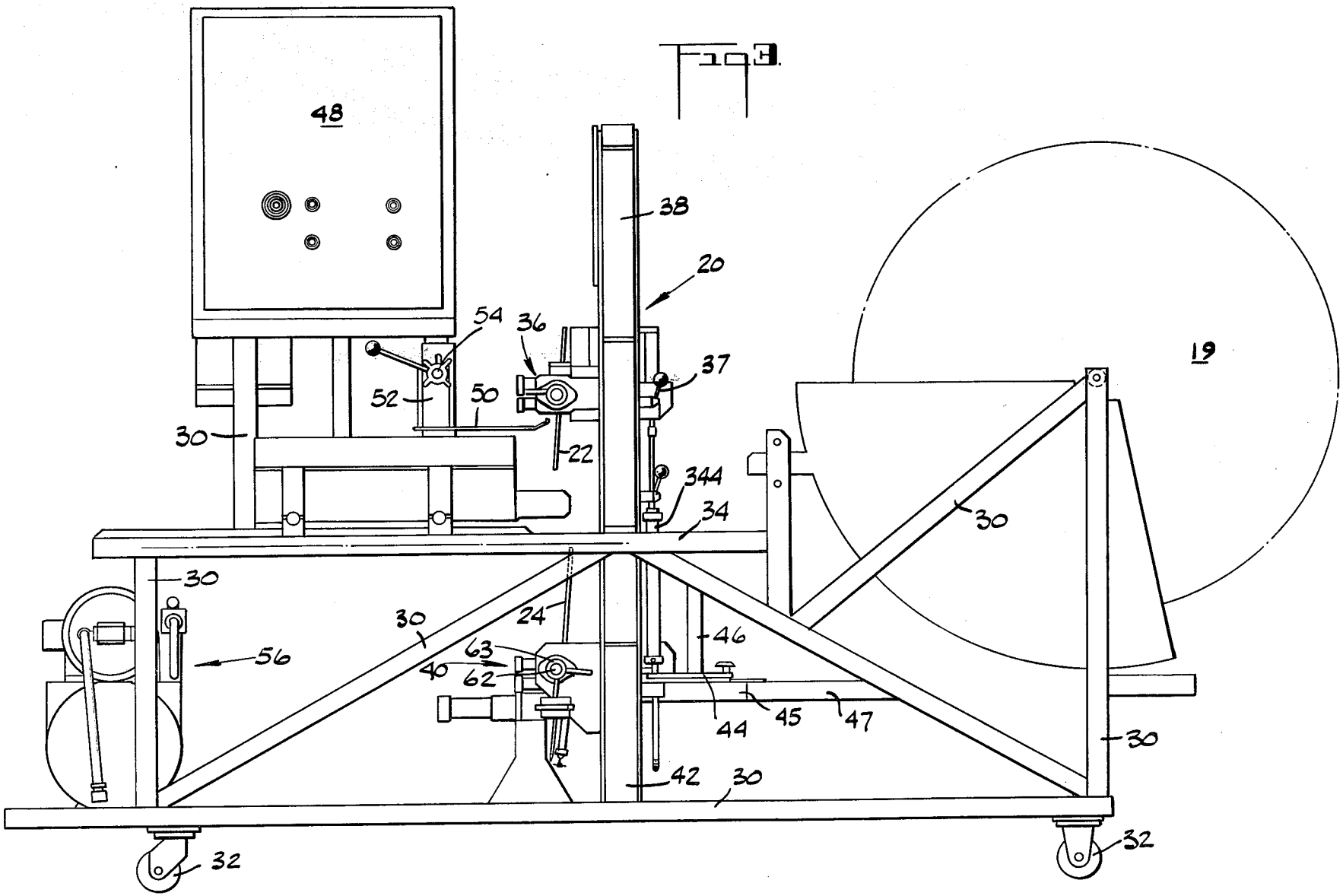
19
30
32
30
47
45
44
46
30
42
20
37
344
34
38
22
36
24
63
62
54
50
40
52
30
48
56
30
30
32

58
22
18
24
62
50
2
34
70

210
212
214
216
218
220
222
266
M
224
224
226
234
228
230
236
232
242
244
240
246
248
238
250
252
258
256
264
260
254
262
267
274
356
268
354
270
T11
272
301
278
269
T0
D9
276
T1
300
302
350
T9
312
C1 to C9
320
J
T4
304
360
T7
D7
H
340
362
314
364
T3
364
269
T8
D12
348
290
T10
346
T2
G
310
338
336
298a
D6
T6
304
232
I
T5
332
334
B
J
A
C
D
E
F

Fig. 15.

DRUM SWITCH POSITION

| STEP | D1 | D2 | D3 | D4 | D5 | D6 | D7 | D8 | D9 | D10 | D11 | D12 | T |
|---|---|---|---|---|---|---|---|---|---|---|---|---|---|
| START | | | | | | | | | | | | X | T0 |
| 1 | X | | | | | X | X | | X | | | X | T1 |
| 2 | X | X | | | | X | | | | | | X | T2 |
| 3 | X | X | | | | X | | | | | | X | T3 |
| 4 | X | X | | X | | X | | | | | | X | T4 |
| 5 | X | X | | X | X | X | | | | X | | X | T5 |
| 6 | X | | | X | X | X | | | | | | X | T6 |
| 7 | X | | | | | X | | | | | | X | T7 |
| 8 | X | | | | | X | | X | | | | X | T8 |
| 9 | | | | | | X | | X | | | | X | T9 |
| 10 | | | | | | X | | | | | | X | T10 |
| 11 | | | | | | X | | | | | | X | T11 |

APPARATUS FOR FORMING THERMAL INSULATION BLOCKS

BACKGROUND OF THE INVENTION

The invention herein relates to an apparatus for forming thermal insulation blocks.

In the past it has been common to insulate high-temperature devices such as furnaces with fibrous insulations. Commonly used fibers have been glass fibers and refractory (usually aluminosilicate) fibers, which have commonly been in the form of batts or blankets. Such batts and blankets have been attached to the walls of the furnaces using impaling pins. The flexibility of such batts and blankets, and the fiber shrinkage which normally occurs at elevated temperatures, frequently causes gaps to open in the insulation, particularly at joints between adjacent insulation units. This, of course, significantly reduces the insulating value of the material.

Recently, modular thermal insulation has appeared commercially. Such insulation comprises blankets or batts of fibrous insulation folded into U-shapes and/or serpentine shapes and compacted into unitary blocks commonly measuring about 1 foot (30 cm) on a side and having a thickness of usually about 4–12 inches (10–30 cm). Such blocks are attached to a furnace wall in a parquet pattern, usually under compression, such that when shrinkage of the fiber occurs at the elevated temperatures in the furnace shrinkage occurring along the fiber direction of one block will be offset by the compression of the fibers in the adjacent modules. Typical of such blocks are those shown in U.S. Pat. Nos. 3,952,470 and 4,001,996, both issued in name of C. O. Byrd, Jr. Modular insulation of this type is available commercially under the trademark Z-BLOK from the Johns-Manville Corporation.

Initially such blocks were fabricated by hand. Such hand operations are of course undesirable, because they are slow and uneconomic. It would therefore be highly desirable to have apparatus which would not only fold the material into the desired shape and size for the block but also simultaneously insert into the folded material the supporting means by which the fibers are subsequently attached to mounting brackets and locked in place for subsequent mounting in a furnace or similar high temperature environment.

SUMMARY OF THE INVENTION

The invention herein is an apparatus for the formation of blocks of folded fibrous materials, which comprises: (a) folding means to form sequential transverse folds in a fibrous body, each fold being made in the direction opposite to the direction of the previous fold; (b) inserting means for inserting supporting members into folds in said fibrous body as said folds are being formed by said folding means; and (c) sequencing means to identify, according to a predetermined pattern, those specific folds into which said supporting members are to be inserted by said inserting means and to control said inserting means to insert said supporting members into only those identified folds.

BRIEF DESCRIPTION OF THE DRAWINGS

FIG. 3 is a side elevation view of one embodiment of the apparatus of the present invention.

FIGS. 11, 12 and 13 are side elevation views, partially in section, showing sequential steps in the operation of the inserting means of FIG. 10.

FIGS. **14*a*–14*b*** show a schematic diagram of the electrical circuitry of the sequencing and operation means of this apparatus.

FIG. 15 is a diagram of the operating settings for the rotary drum switch used in the sequencing means of this apparatus.

Figure 16:
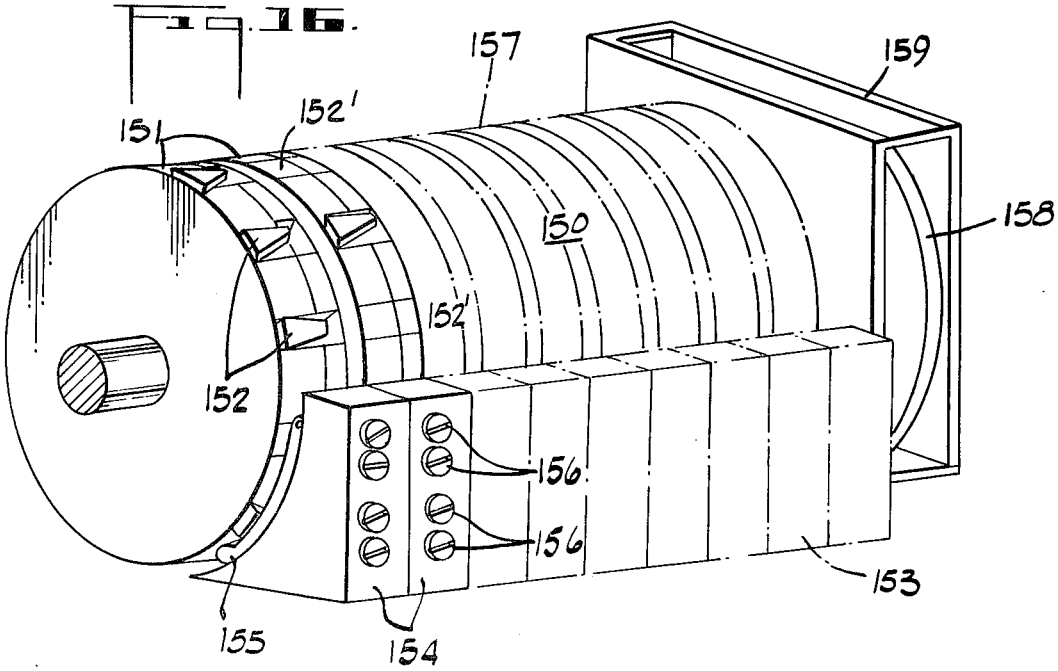

FIG. 16 is a perspective view, partially in phantom, of the drum switch used in the sequencing means in this apparatus.

DETAILED DESCRIPTION AND PREFERRED EMBODIMENTS

Figure 2:
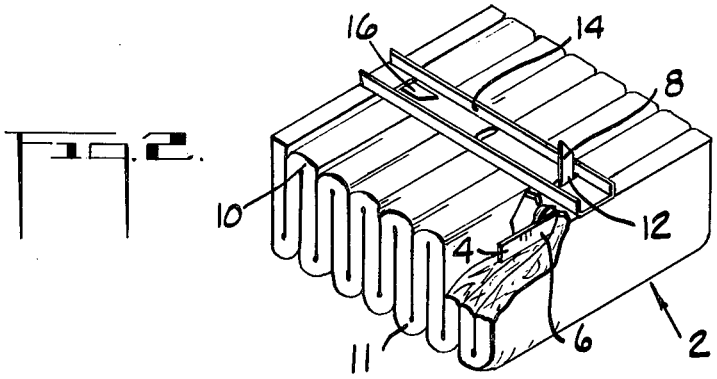
FIG. 2 is a representation in perspective of a typical thermal insulation block with one portion broken away to illustrate the positioning of an internal supporting member.
Figure 10:
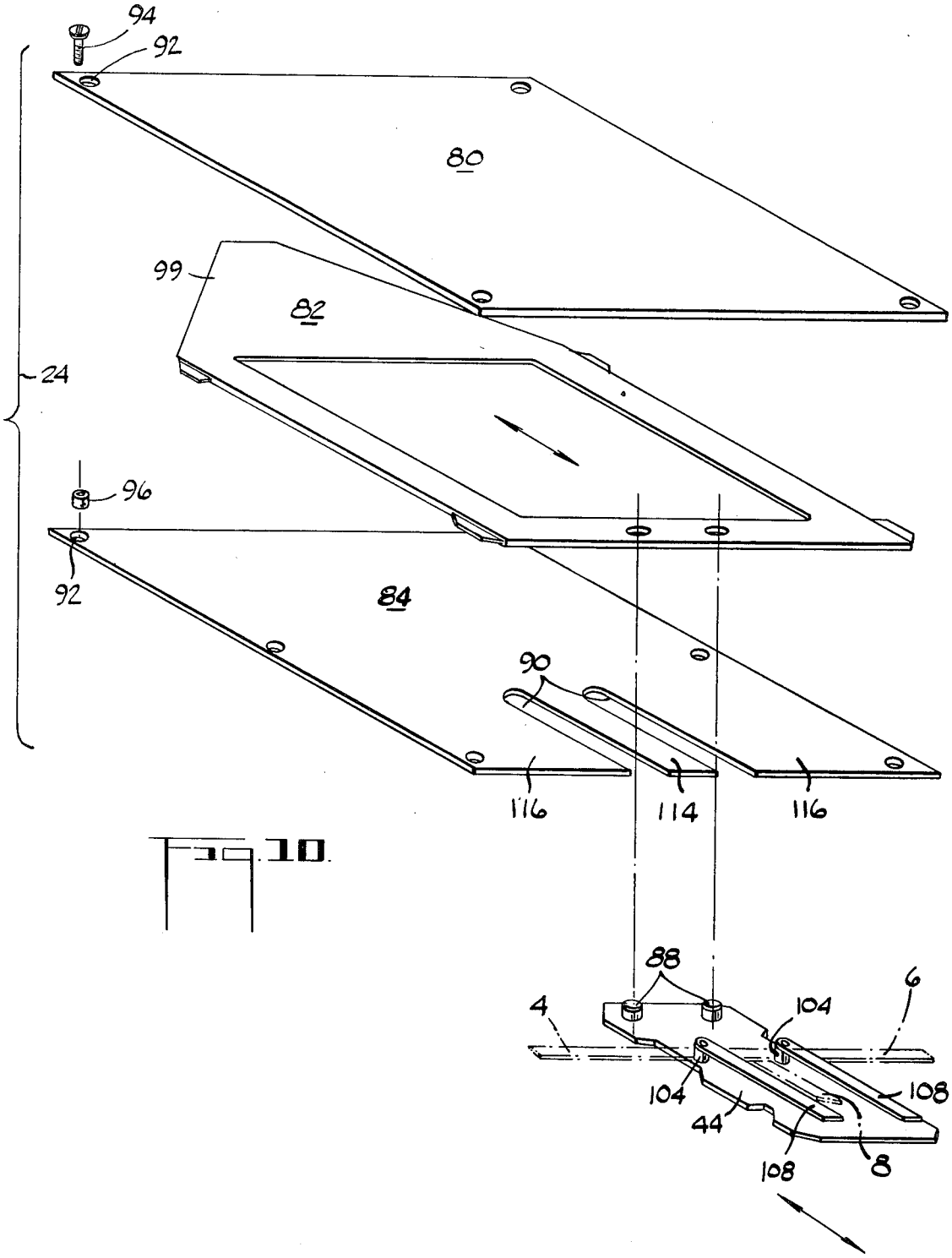
FIG. 10 is an exploded view showing the relationship of several parts of the supporting member inserting means of the apparatus.

The invention herein is best understood by reference to the drawings. FIG. 2 shows a typical insulation block having the serpentine folding of the block shown in U.S. Pat. No. 4,001,996. A corner of the block 2 is shown cut away so that the supporting member ("beam") 4 can be seen. A typical beam is also shown in FIG. 10. It will be seen that the beam 4 comprises a generally longitudinal bar 6 from which a prong 8 protrudes at right angles. In the structure of block 2 the prong 8 sticks through an inner fiber fold 10, and is thereafter inserted through an opening 12 in a back channel 14 and crimped over as at 16 to lock the folded blanket into a unitary block. Further details of this type of construction are to be found in the aforementioned U.S. Pat. No. 3,952,470.

The purpose of the present apparatus is to form the folded blanket portion of the block and simultaneously insert the supporting member (beam) with its penetrating prong so that the finished block can be completed simply by laying a back channel 14 over the protruding prongs 8 and crimping them into place. Since the beams are not normally placed in all folds of the block as shown in the aforementioned U.S. Pat. No. 4,001,996 and also in FIGS. 1 and 2 of the present drawings, it is also a critical element of the present apparatus that the apparatus contain sequencing means to permit the operator to predetermine the insertion pattern of the beams.

Figure 1:
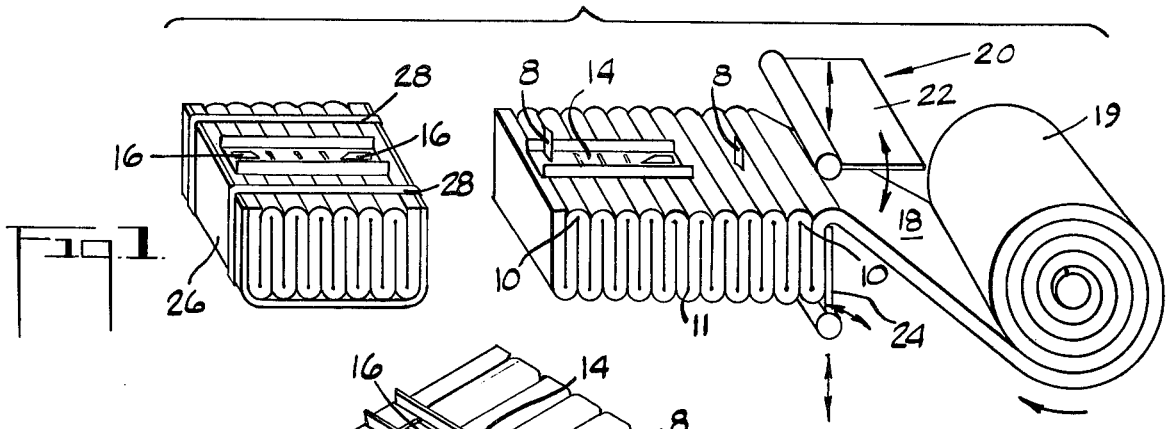
FIG. 1 is a schematic representation illustrating the formation of a typical thermal insulation block.

The overall operation of the apparatus of the present invention is illustrated schematically in FIG. 1. A sheet of fibrous material 18 from roll 19 is fed into the folding means 20 of the apparatus. (The sheet 18 will be referred to herein for convenience as a "blanket." However, it will be understood that any generally longitudinal sheet-like body may be used, such as those known as batts, webs, blankets, mats, felts and so forth.) Folding means 20 comprises a pair of opposed folding blades 22 and 24 which operate alternately and in sequence to form transverse folds of opposite direction in the continuous blanket material. Simultaneously, by means which will be described below, the lower folding blade 24 inserts, at predetermined intervals, beams 4 into and through the inner folds 10. Thereafter, back channels 14 are placed over the protruding prongs 8 and the prongs are crimped into position to form the completed block. For convenience in subsequent shipping, handling and installation, it is common to compress the outer folds 11 of the block 2 somewhat and then wrap three sides of the block with a protective material such as cardboard 26 which is held in place by bands 28. Once the block is in place in the furnace or other high temperature environment, the bands 28 are cut and the protective cardboard 26 removed to release the compression in the block to force the fiber into close alignment with the fiber of the adjacent blocks.

One principal and preferred embodiment of the apparatus of the present invention is shown in FIG. 3 and subsequent figures. The various components of the apparatus are supported on a framework 30 which is conveniently mounted on wheels or casters 32 for mobility. At one end of the apparatus is supported a roll 19 of the fibrous blanket 18. Blanket 18 is pulled off this roll 19 and along table 34 by the folding motion of the apparatus, as will be described below. Folding means 20 are disposed with upper blade 22 above table 34 and lower blade 24 below table 34, with the shafts 58 and 62 around which the blades 22 and 24 respectively rotate, being generally vertically aligned. (A horizontal alignment, or one at some intermediate angle, could also be used, but that would require an equivalent alignment of table 34, framework 30, roll 19 and various other components, or would require twisting of the blanket 18. Since these arrangements are inferior to the embodiment shown, they are not recommended.) Upper blade 22 is mounted on a movable support 36 which is shown in more detail in FIGS. 5 and 6. Support 36 is adapted to move both vertically in guideway 38 and horizontally under the urging of lower folding blade 24 or a spring 70 as will be described below. Lower folding blade 24 is mounted in support 40 which is adapted to move vertically in guideway 42. In its horizontal position, lower folding blade 24 is aligned with beam carriage 44 which is normally disposed directly below beam magazine 46 and supported on rails 45 which are attached through beams 47 to framework 30. Sequencing means 48 determines when lower folding blade 24, which engages beam carriage 44 on each cycle, will operate to withdraw a beam 4 from magazine 46 and insert it into the predetermined fold 10; this operation is shown in FIGS. 10 through 13. The pattern of beam insertions is predetermined by circuitry in sequencing means 48 which counts the cycles of the apparatus and directs beam insertion after predetermined numbers of folds have been made. Both counting and command circuitry are shown in FIG. 14 and described below. Selector switches to be described below are mounted on the exterior panel of sequencing means 48 to permit variation in the beam insertion pattern by appropriate circuitry changes.

The apparatus also contains plates 50 which in cooperation with table 34 retain the folded blanket in position and the layers of folded blanket generally upright until the operator can place the back channel 14 over the prongs 8 of the beams 4 by hand after the predetermined number of folds 10 and 11 have been pushed past the folding means 20 along table 34. The blocks are cut by hand from the running folded material by slitting through the next upper fold after the predetermined number of folds in a block have been completed. Plates 50 are adjustable vertically in guideway 52 by means of clamp 54 such that blanket folds of varying heights can be accommodated by the present device to form modules of correspondingly varied thicknesses. Motive power unit 56 provides the means for operation of the entire unit and contains a motor which drives a hydraulic pump. The pump is in turn operably linked by hydraulic lines to the various rotary cylinders and pistons which operate to move the conponents of the apparatus, as described below. These devices are conventional and therefore are not shown in detail in the drawings. The folding means 20 can normally be most readily operated hydraulically while the sequencing means 48 can be wholly electronic or can be a combination of electrical and mechanical components as described below.

Figure 5:
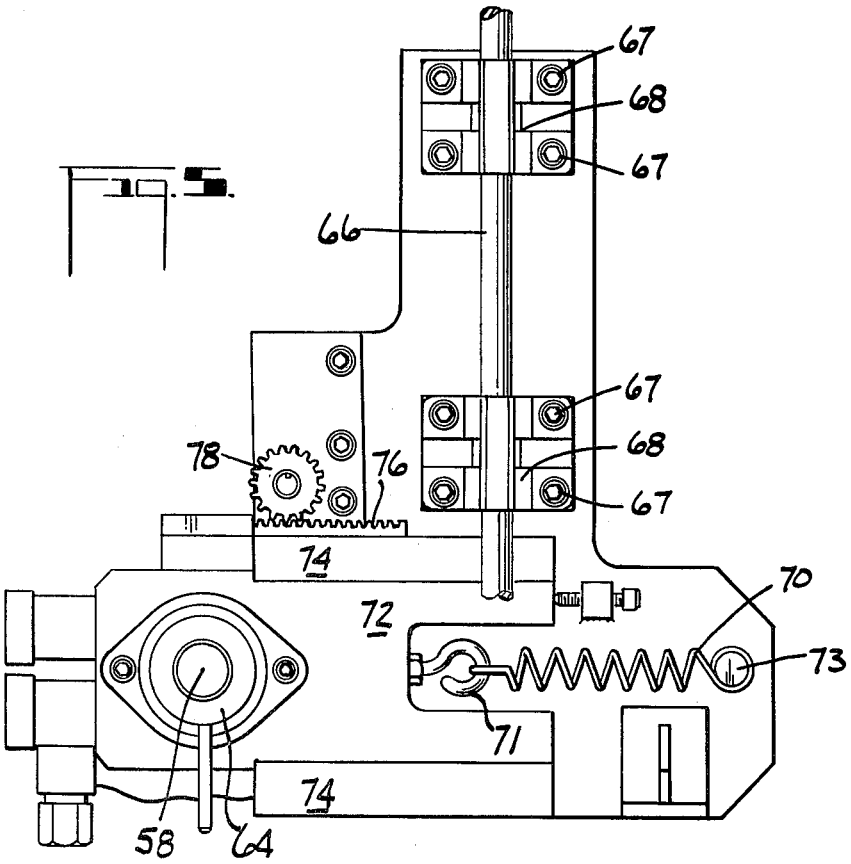
FIG. 5 is a side elevation view showing a portion of the folding means in the embodiment shown in FIG. 3.
Figure 4:
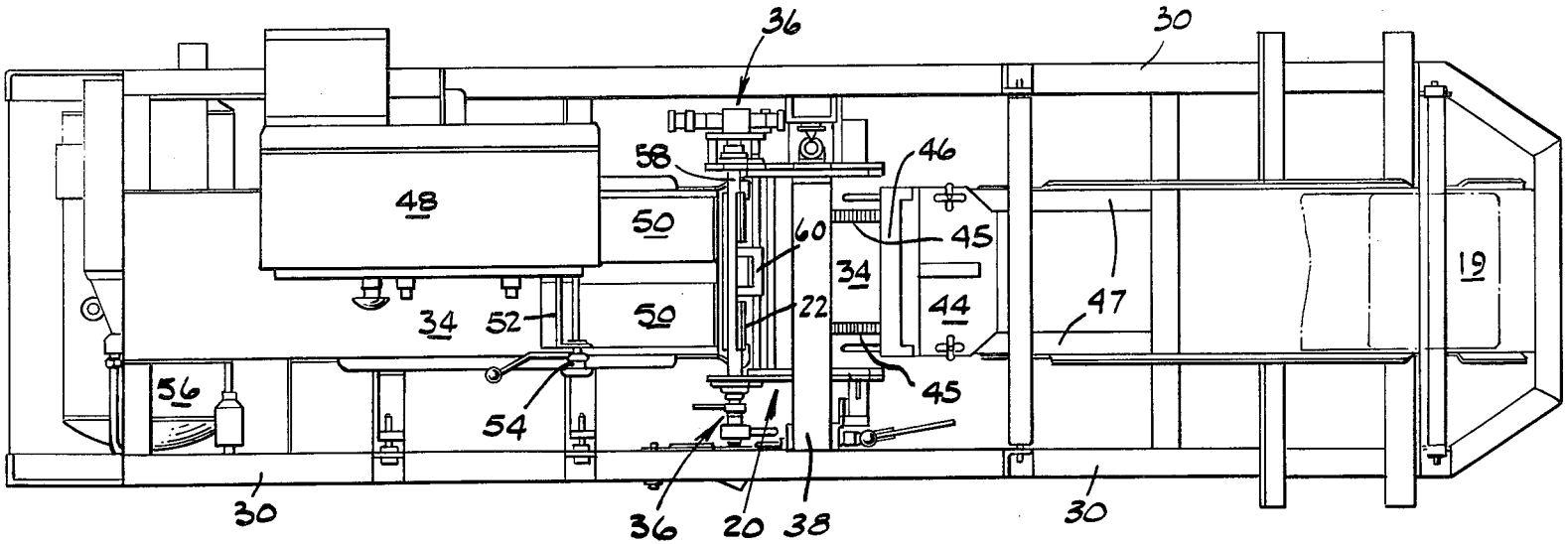
FIG. 4 is a plan view of the embodiment shown in FIG. 3.
Figure 6:
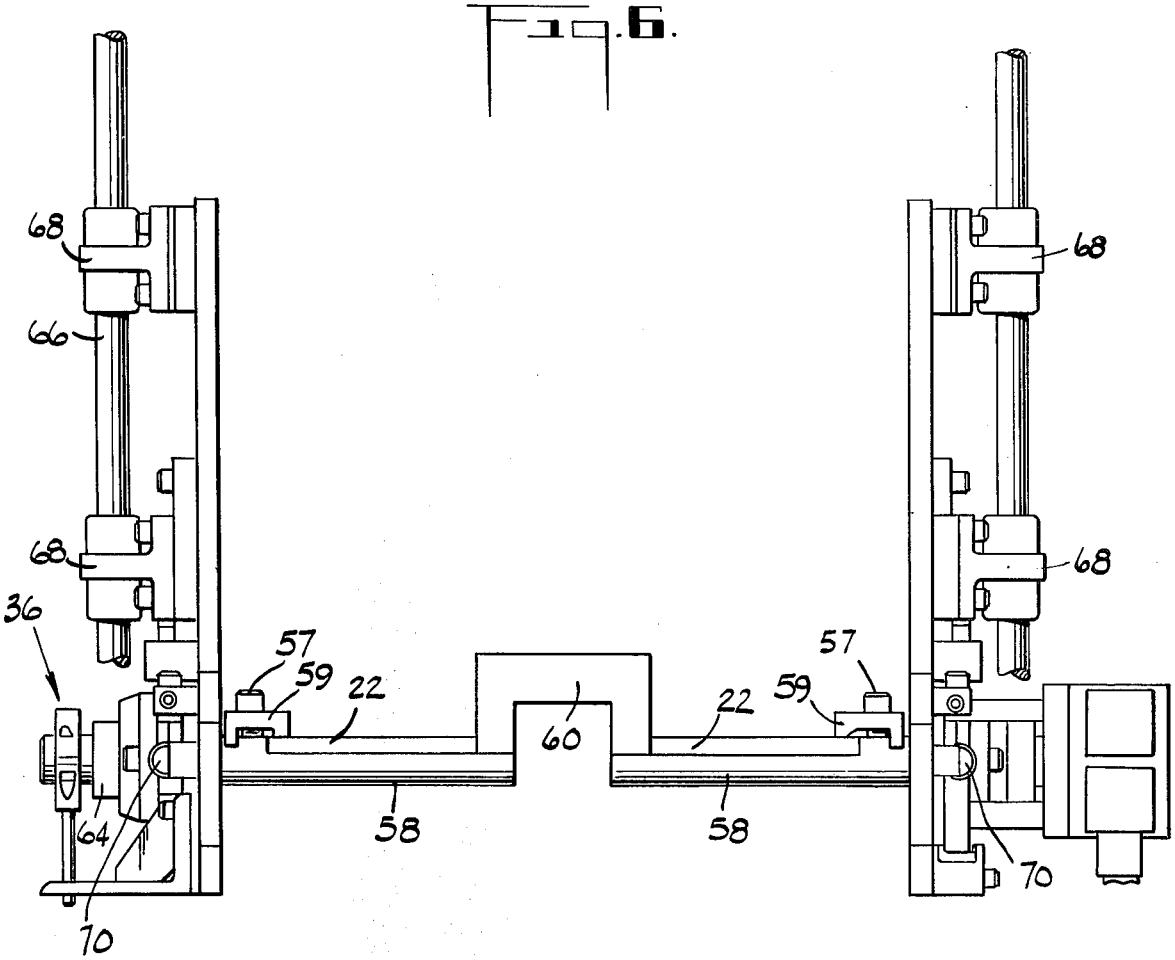
FIG. 6 is an end elevation view of a portion of the folding means in the embodiment shown in FIG. 3.
Figure 7:
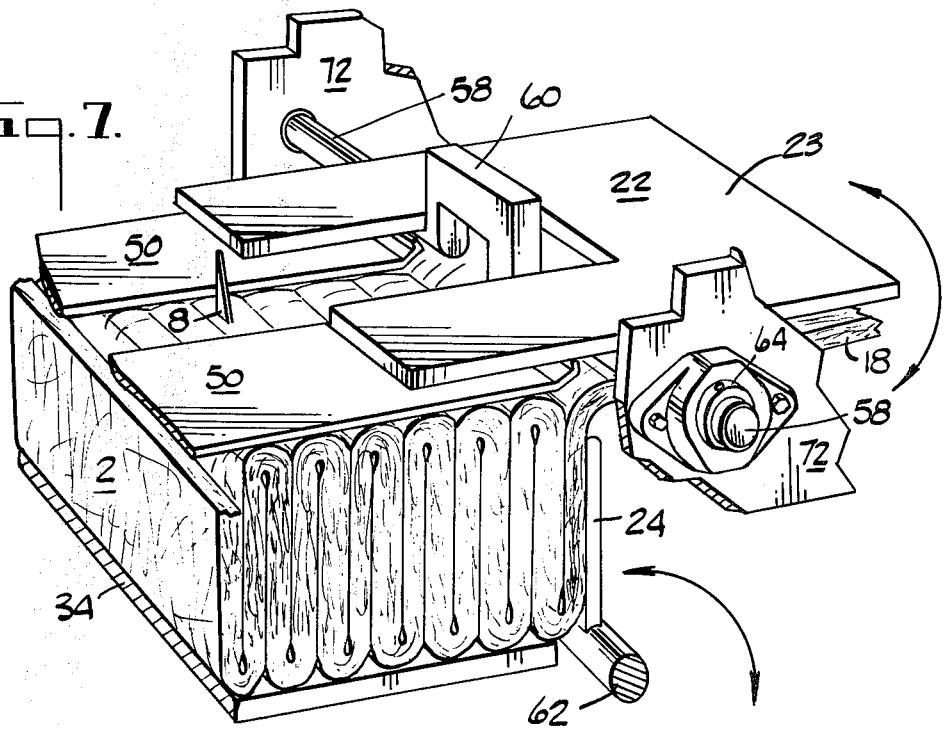
FIGS. 7 and 8 are perspective views showing two sequential steps in the folding of the insulation block.
Figure 8:
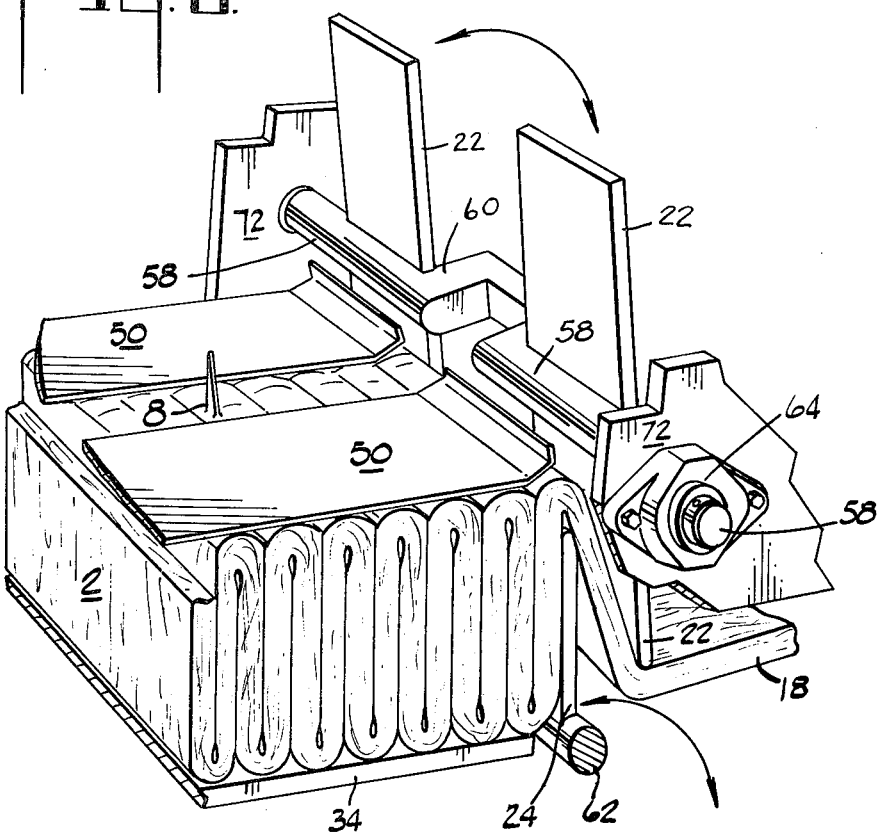
Figures 9A, 9B, 9C, 9D, 9E, 9F, 9G, 9H, 9I:
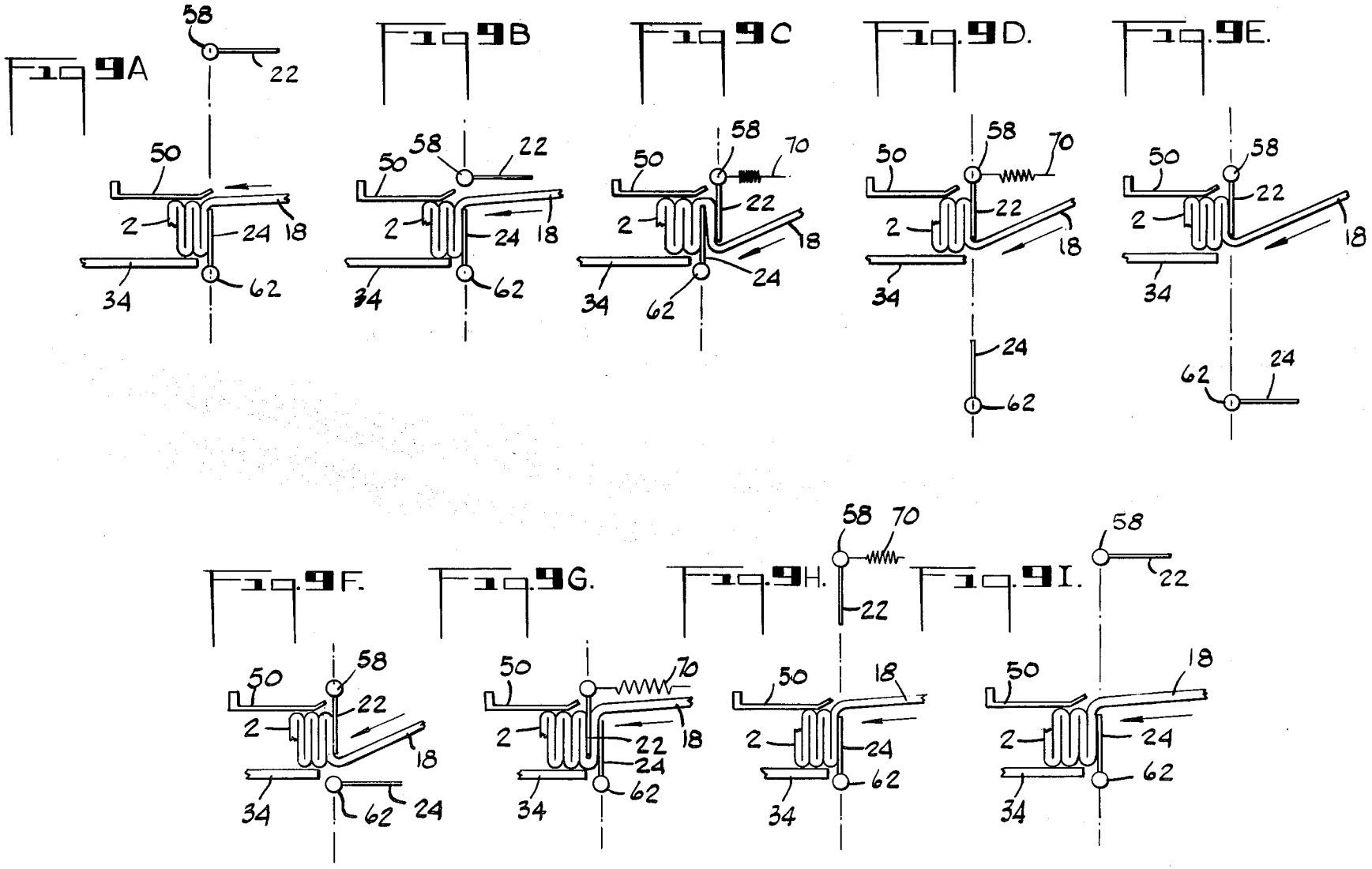
FIGS. 9A–9I show in nine schematic views an entire cycle in the formation of two folds in the insulation block of this invention.

FIGS. 5–9I illustrate in more detail the mechanics and structure of the folding means. The nine views of FIGS. 9A–9I show the eight steps of folding utilizing the two blades 22 and 24 (FIG. 9I is identical to FIG. 9A and represents the beginning of the following cycle). In FIGS. 7 and 8, the operations of FIGS. 9B and 9C are shown in more detail. Upper blade 22 pivots on shaft 58 which is journaled in a pair of bearings 64 each of which in turn is mounted on a sliding block 72 (one only of the pair of bearings 64 and blocks 72 is shown). Shaft 58 has an arched center section 60 to permit vertical clearance of the prongs 8 as each fold of the blanket is moved away from folding means 20 during subsequent folding cycles. Lower blade 24 is mounted on shaft 62 which is journaled in a similar bearing 63 on unit 40. (It will be evident from the drawings that to a significant extent the apparatus is axially symmetrical, such that shafts are journaled in paired bearings which move in paired supports, etc. Therefore, in the discussion below, description of a single element will be intended to cover the companion element of the pair also.)

Support 36 is shown in more detail in FIG. 5. Sliding block 72 on which is mounted the bearing 64 journaling shaft 58 slides in guideway 74. Rack 76 and pinion 78 maintain alignment of the unit. Vertical motion in guideway 38 is accomplished using vertical rod 66 and rod guides 68 which are attached by bolts 67 to support 36 and actuated by hydraulic cylinder 344 (a similar hydraulic cylinder on the opposite side of table 34 and shown schematically as 308 in FIG. **14*b* actuates the vertical movement of lower support 40**).

Spring 70 comes into operation in those portions of the folding operation shown in FIGS. 9C, 9D, 9G and 9H. As lower blade 24 folds upwardly in a counter-clockwise direction, shafts 58 and 62 are originally aligned vertically. In order for the blade 24 to complete its counter-clockwise turn without crushing the fibers of the blanket 18, provision must be made for blade 22 to be movable horizontally. This is accomplished by the use of sliding block 72 in guideway 74. The motion of the lower blade 24 simply pushes the shaft 58, block 72 and blade 22 horizontally a distance essentially equal to the width of the single blanket thickness as shown in FIG. 9G. In order for the blade 22 to come into proper alignment again, it must be retracted as it is pulled vertically out of the previous fold as shown in FIG. 9H. This retraction is accomplished by spring 70 acting as a tension spring anchored to hook 71 attached to sliding block 72 and at the other end to post 73 fixed to support 36.

In the steps shown in FIG. 9C and 9D, spring 70 acts as a compression spring rather than a tension spring and allows blade 22 to move horizontally to the right to accommodate the thickness of the blanket. Once the lower blade 24 has retracted as shown in FIG. 9D, spring 70 forces the block 72 forward to the correct alignment position.

The structure and operation of the "inserting means" is shown in FIGS. 10–13. Lower blade 24 (which has heretofore been considered as a solid member for simplicity) is in fact a "sandwich" of three separate components: upper plate 80, lower plate 84 and retractor plate 82 which is disposed between upper plate 80 and lower plate 84 and is longitudinally slidable therebetween. Plates 80 and 84 are spaced apart to allow free movement of plate 82 and are held together by screws 94 which project through spacers 96 and are threaded in holes 92; these screws also act as guides for the motion of retractor plate 82. It will be noted that retractor plate 82 contains holes 86 and lower plate 84 contains slots 90, the function of which will be explained below.

Also shown in FIG. 10 is beam carriage 44 which holds a single beam 4 disposed between front pegs 88 and rear pegs 104. Mounted on top of rear pegs 104 are slides 108.

Figure 11:
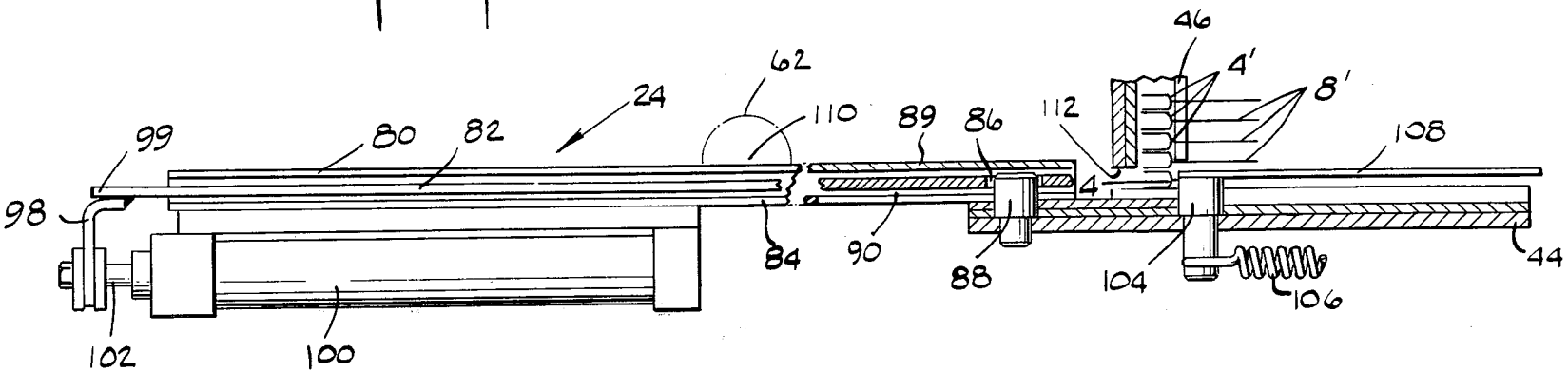

In operation, the first step of which is shown in FIG. 11, a hydraulic rotary cylinder (designated 318 in FIG. **14*b*) causes lower blade 24 to pivot around pivot point 110 (the center of shaft 62) to the horizontal position which corresponds to the portion of the cycle shown in FIG. 9E. At this point, front pegs 88 project through the front end of slots 90 and are engaged in holes 86. Carriage 44 is in its normal retracted position with a single beam 4 lying on it and additional beams 4' stacked above beam 4 in magazine 46. If the predetermined pattern controlled by sequencing means 48 determines that this particular cycle is not one in which a beam is to be inserted into a fold, no internal motion of blade 24 occurs and at the next appropriate point in the cycle the blade 24 simply moves upward disengaging holes 86 and slots 90 from front pegs 88. The lower blade 24 therefore merely makes another fold in the blanket as shown in steps 9F through 9H. Carriage 44** does not move from its normal retracted position.

Figure 12:
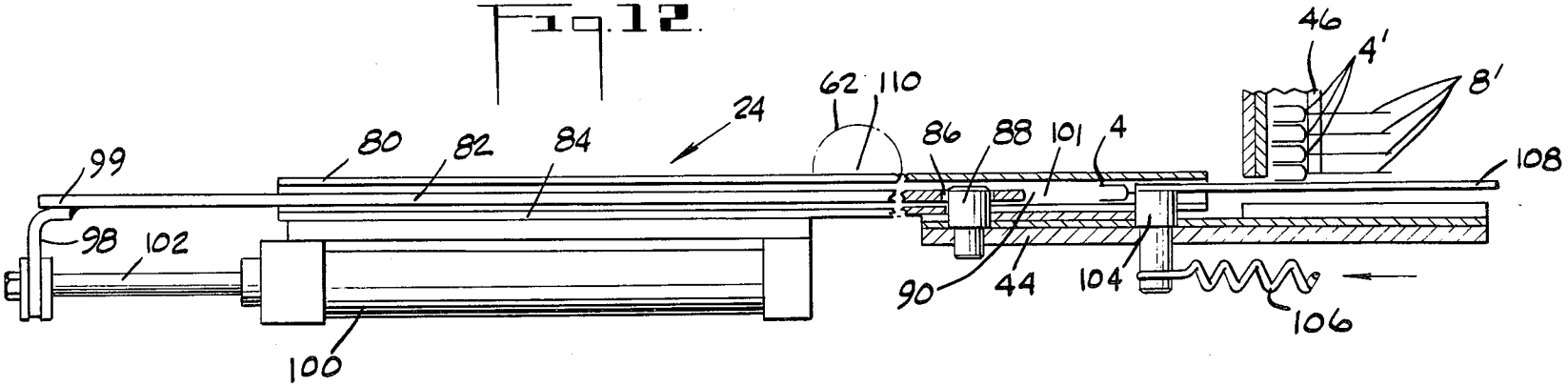
Figure 11:
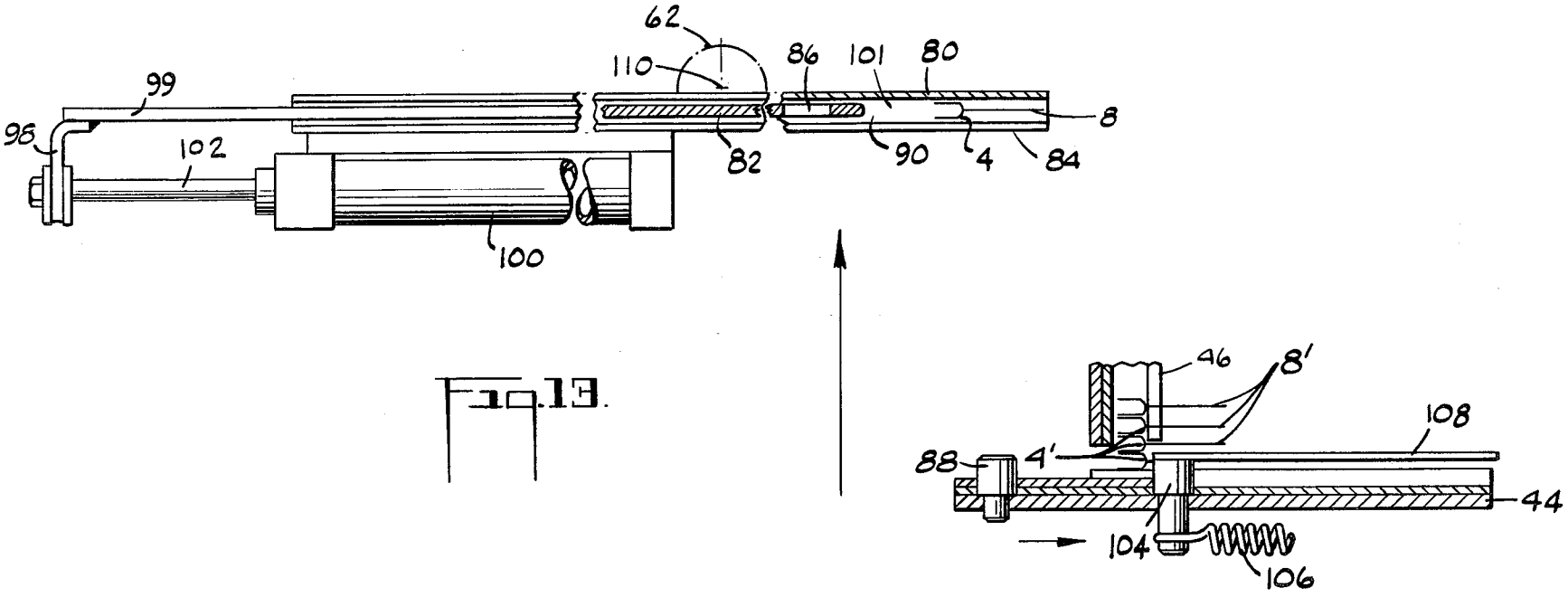

On the other hand, if the predetermined pattern controlled by sequencing means 48 determines that this particular cycle is one in which a beam 4 is to be inserted into an upper fold 10, the steps shown in FIGS. 12 and 13 then occur during the portion of the cycle indicated by FIGS. 9E and 9F. In this operation, piston 100 which is fixed to lower plate 84 is activated by activator 328 (FIG. **14*b*) to force out piston rod 102 which is connected by bracket 98 to end 99 of retractor plate 82 which projects beyond the back edge of plates 80 and 84. As piston rod 102 moves outward it pulls with it retractor plate 82. Because plate 82 is engaged through holes 86 with front pegs 88, this also causes the horizontal motion of carriage 44 against the action of spring 106 which is coupled to the lower projection of rear peg 104 and anchored to rails 45. As the carriage 44 moves, rear pegs 104 engage the main body 6 of beam 4 and pull beam 4 under the lower edge 112 of magazine 46. As the piston continues to move outward (to the left in the drawings) retractor plate 82 moves with it and carriage 44 is moved under plate 84 to the full length of slots 90. Beam 4 is therefore carried by rear pegs 104 into the open space 101 between plates 80 and 84 which has been created by retraction of plate 82. The length of slots 90 is determined by the height of prong 8 on the beam 4; the entire beam including the prong must be moved into the open space 101. Meanwhile, remaining beams 4' (with their prongs 8') have been restrained from dropping out of magazine 46 by the action of slides 108 which provide temporary support for the beams 4' after the removal of the bottom beam 4**.

After piston rod 102 has reached its full extention bringing the carriage to a position with front pegs 88 moved substantially completely to the rearward ends of slots 90, blade 24 moves upward carrying with it piston 100. The vertical movement causes disengagement of holes 86 from front pegs 88 thus freeing carriage 44 to be pulled back to its normal retracted position by the action of spring 106. Simultaneously beam 4, which after being pulled into the opening 101 in blade 24 is now resting on sections 114 and 116 of plate 84, is pulled upward and disengaged from pegs 104. Held in a generally loose fit by the sandwich arrangement of plates 80 and 84, beam 4 is now moved upward to be inserted into the blanket as part of steps 9F through 9D. This particular action is not shown in FIG. 9 but in practice is accomplished by keeping the piston rod 102 extended after the blade 24 reaches a vertical position and then at a sequential step in the cycle (normally at the end of step 9C) causing the piston rod 102 to be retracted by piston 100 such that retractor plate 82 moves back into the opening 101 between plates 80 and 84 and pushes beam 4 out of the opening 101, simultaneously driving prong 8 through the blanket fold 10. Meanwhile as carriage 44 has retracted, slides 108 have moved out from under the magazine 46 and permitted the stack of beams 4' to drop down one beam width. A new beam 4 then rests on carriage 44 as shown in FIG. 10 and the insertion operation is ready to begin again at the next appropriate point in the predetermined pattern controlled by sequencing means 48.

The apparatus is manually adjustable to accommodate blocks of different thicknesses. Lower plate 24 is slidably attached to shaft 62 and can be moved such that the front end portion 89 is extended at varying distances measured from shaft 62. Once lower plate 24 is extended to the proper distance to fully fold the lower half of the blanket (as shown in FIG. 7) it is locked to shaft 62 by conventional clamps (not shown but equivalent to clamp 59 for upper plate 22). This of course also requires that magazine 46 and carriage 44 be adjusted horizontally along rails 45 to obtain correct alignment between the cooperating components of lower plate 24 and carriage 44 and proper feed of beams 4 from magazine 46. Adjustment of the position of the pivot point (center) of shaft 62 is not required because the end of its vertical travel ends at table 34 whose position remains fixed regardless of the thickness of the block.

Adjustment of upper plate 22 to compensate for different block thicknesses requires adjusting both the extension of the front portion 23 of plate 22 and also the location of the pivot point (center) of shaft 58 (and guide 50) because the top of the block will vary in position above fixed table 34. Extension adjustment is accomplished by loosening screws 57 which tighten clamps 59 (FIG. 6) which in turn secure upper plate 22 to shaft 58, thus allowing plate 22 to be slid relative to shaft 58. When the proper extension is obtained, clamps 59 are tightened with screws 57 to secure plate 22 in the new position. The pivot point of shaft 58 is adjusted by moving the assembly containing support 36 and cylinder 344 vertically along guideway 38 and then securing it in its new position by means of screw clamp 37.

FIGS. 14*a*–14*b*, 15 and 16 depict the electrical circuitry and drum switch programming to operate the various steps of the apparatus.

FIG. 16 shows the programable drum switch 200. This unit is a cylindrical device 157 which has on its surface 150 a plurality of circumferential rows 151, each of which contains an equal number of tabs 152. Tabs 152 can be positioned up as at 152 or down as at 152'. Adjacent to surface 150 is a cam block 153 which has a plurality of segments 154 equal in number to the number of rows 151. Each segment 154 contains a spring loaded cam follower 155 which is urged into segment 154 when it contacts a raised tab 152 but remains out of segment 154 when opposite a depressed tab 152'. Movement of cam follower 155 inward causes two normally open switches to be closed and two normally closed switches to be opened within the segment 154. Return movement outward by the cam follower 155 reverses the sequence. By use of the proper screw contacts 156 of the internal switches, each segment 154 can be wired to function as a make-break switch or a break-make switch as the cylinder 157 rotates. By motor means (not shown) the cylinder 157 is indexed radially by single steps such that each tab 152 in a row, whether up or down, is brought sequentially under its row's cam follower 155 and held there until the next indexed step. At one end of the cylinder 157 is a separate but coaxial contact wheel 158 which rotates inside a housing 159. Wheel 158 has on its surface a plurality of taps equal in number to the number of tabs in a single row 151, and housing 159 contains a single tap which contacts sequentially and individually each of the wheel taps as the wheel 158 rotates in unison with the cylinder 157. In the embodiment of the invention shown in the drawings, an Eagle Signal a programmable drum switch, Model MT11A61205, with twelve belts of twelve tabs each and twelve taps, was used. In FIG. 15, an "X" in a box indicates an "up" position for a given tab and a blank box represents a tab in the "down" position. Each cylinder belt or row is designated by the letter "D" while each tap is designated by a "T". Each of the cam block segments 154 is wired as a make-break switch except "D12" which is wired as a break-make switch. Each of the taps T also operates as a break-make switch.

Figure 14A:
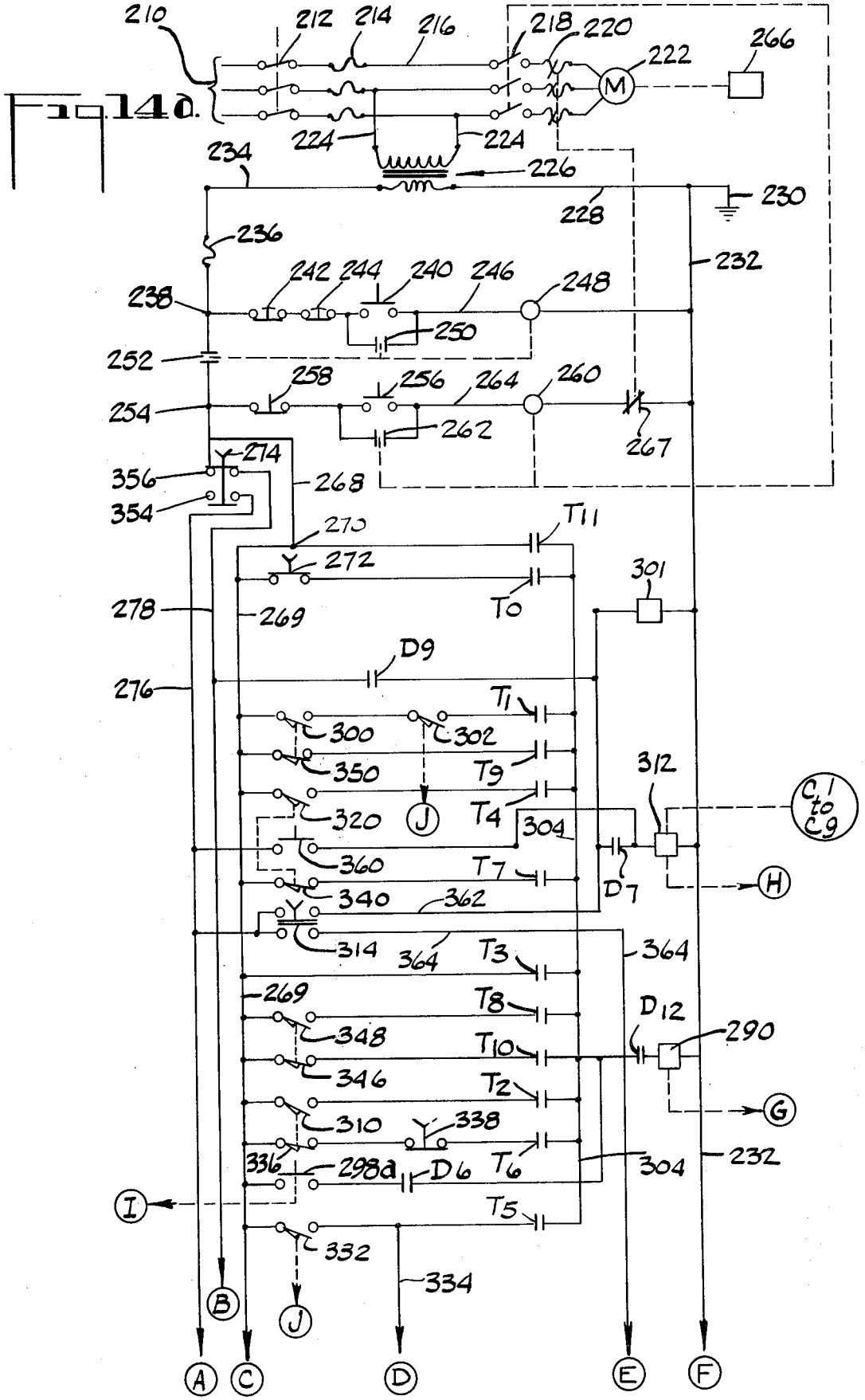

FIG. 14*a*, line power is provided from an external source (not shown) through three-conductor line 210. Typically, this will be 230/460 volt, three-phase power. This main power is fed through main switch 212 and main fuse 214 and continues through three-conductor line 216 and through motor switch 218 and overload circuit breaker 220 to motor 222. Motor 222 drives a hydraulic pump 266 which in turn provides hydraulic power to operate the various mechanical components previously described. Each hydraulic line contains an electrically actuated valve which operates upon a signal from the circuitry to be described below. Each valve will be individually actuated at a predetermined time according to the tab settings on the drum switch 200.

Power for the control circuitry is taken from a tap across one half of line 216 through line 224 and fed to transformer 226 where it is further reduced to the control line operating voltage. One side of the secondary of transformer 226 is grounded through line 228 and ground 230. Ground 230 also serves as the ground for common line 232.

The main control power from the secondary side of transformer 226 is fed through line 234 and fuse 236 to junction 238.

Figure 14B:
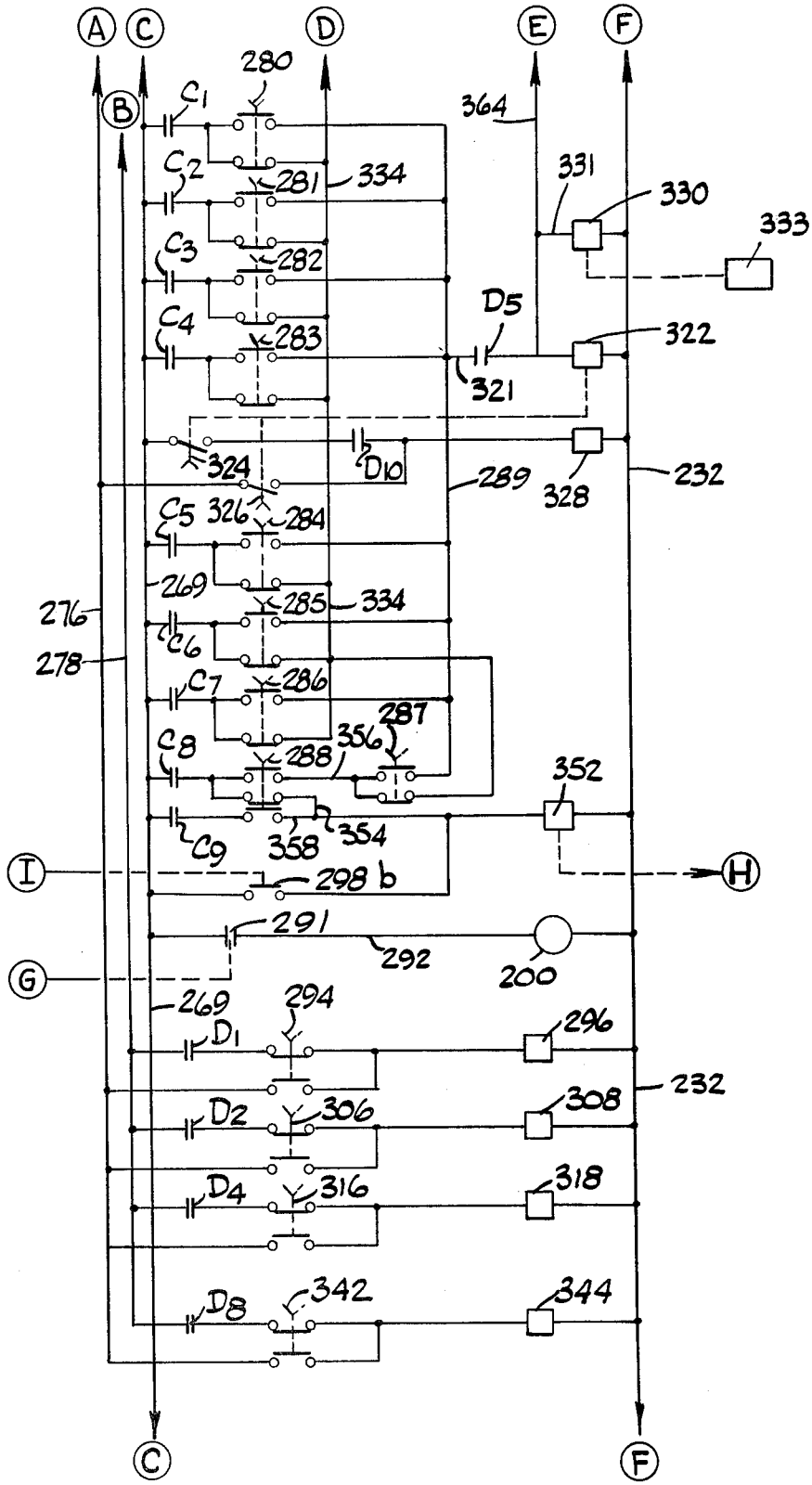

The circuitry and switch positions shown in FIGS. 14*a*–14*b* correspond to the "start" step shown in the table in FIG. 15. It will be seen from FIG. 15 that in the start position, only the tab in row D12 on the cylinder of drum switch 200 is up and in contact with its cam follower. Contacts TO are also closed. To activate the system the operator pushes switch 240, a normally open pushbutton switch. This permits current to flow through control panel stop switch 242 and emergency stop switch 244, both of which are normally closed pushbutton switches. (Emergency stop switch 244 can be located at a position remote from the apparatus control panel 48 and strategically located to be readily and immediately available to the operator.) The power passes through line 246 to control relay 248 (typically Cutler Hammer 2-pole relay Model No. D23MR20). Activation of relay 248 closes contacts 250 and 252 thus maintaining continous power in line 246 and providing power to junction 254.

Next the motor 222 is started by depressing switch 256, a normally open pushbutton switch. This allows power to flow from junction 254 through stop switch 258 (a normally closed pushbutton switch) and on to motor switch relay 260 (typically Cutler Hammer Model No. A30BGTOA61) which, upon activation, closes contacts 262 to maintain power in line 264 after release of pushbutton 256 and also closes switch 218 to start motor 222. As noted above, operation of motor 222 runs hydraulic pump 266 which in turn operates the various hydraulic units in the apparatus. Also in line 264 are normally closed contacts 267 which are operably attached to circuit breaker 220. When motor 222 becomes overloaded in driving hydraulic pump 266, circuit breaker 220 is thrown by the overload causing contacts 267 to open cutting power in line 264 and causing relay 260 to open switches 218 and 262. The entire motor circuit is therefore deactivated and motor 222 is shut off and cannot be restarted until circuit breaker 220 is reset manually and start switch 262 is depressed manually.

The closing of contacts 256 also causes power to flow in line 268 to junction 270 and into line 269. As will be noted from FIG. 15, in the "start" step, contacts TO are closed. The operator sets selector switch 272 to the "single" or "continuous" mode. In the "single" mode the switch is open and allows only a single cycle of the steps of the apparatus (a "cycle" being one full sequence from the "start" step through step 11) and thus the formation of one single fold in the fibrous blanket. In the "continous" mode, the switch is closed and the cycle will be repeated until the operator manually stops the operation by depressing stop switch 242. Conventional selector switches can be used for all selector switches herein; typically Cutler Hammer Model No. 7564K3. The operator also manually sets selector switch 274 to the "manual" or "automatic" setting. In the "manual" position, switch 274 directs power into line 276 while in the "automatic" setting it directs power into line 278. Since the equipment is normally run in the "automatic" and "continous" mode, that sequence will be described first herein to be followed by a description of the "manual" and "single" mode operation.

The operator must also set switches 280–287 to a "no" or "yes" position and switch 288 to a "7" or "8" position. Switch 288 determines how many complete folds (7 or 8) comprise a single block, while switches 280–287 individually determine into which of the folds in each block a beam is to be inserted. For instance, if a block contains seven folds and it is desired to insert beams into the second and sixth folds, switches 281 and 285 would be set to the "yes" position, switch 288 would be set to the "7" position and the remaining switches would be set to the "no" position. In the "yes" position, the switches direct power through line 289 to actuate the hydraulic equipment while in the "no" position, power is directed through line 334 to activate relay 290 to index drum switch 200 one unit as part of step 5 described below. The "no" position circuitry allows the operation to continue even though beams are not being inserted into the remainder of the folds.

In addition, selector switches 294, 306, 316 and 342 will be set to the same setting ("automatic" or "manual") as switch 274. The "automatic" setting of these switches connects the line each is in to line 278 while the "manual" setting connects their lines to line 276.

With contacts TO and D12 closed, selector switch 272 in the "continuous" mode and selector switch 274 in the "automatic" mode, pressing of start switch 240 causes drum sequence relay 290 to close contacts 291 in line 292 to index drum switch 200 one position forward to step 1. As drum switch 200 rotates, break-make contacts D12 momentarily open interrupting power to relay 290 and causing contacts 291 to reopen. This prevents relay 290 from continuously indexing drum switch 200 forward. As each sequential step is reached, contacts D12 are closed but power is only provided to relay 290 upon completion of the step as will be described.

As shown by FIG. 15, in step 1 contacts D1, D6, D7, D9 and D12 are closed. Closing of contacts D1 with selector switch 294 in the "automatic" mode operates rotary actuator 296 which functions to make the top pleater 22 rotate 90° clockwise (FIGS. 9B and 9C). At the beginning of this step, limit switches 300 and 302 are open and 350 is closed. As the top pleater 22 begins its rotation, it causes limit switch 300 to be closed and as it completes its rotation it causes limit switch 350 to be opened.

Closing of contacts D7 and D9 provides power to tab count step relay 312 (typically a Guardian step relay Model No. 24F865) to index relay 312 forward one step. Each step of relay 312 causes one set of relay contacts C to be opened and the next sequential set to be closed (all others are open). Relay 312 thus sequentially cycles through all "C sequences" C1 through C9, as discussed below.

Closing of contacts D9 also operates actuator 301 which withdraws piston 102 into cylinder 100 which causes inner plate 82 to force a beam 4 out of the lower plate 24 and through the just formed fold (FIG. 9C), if a beam 4 has previously been loaded into the lower plate 24 as part of step 5 in the preceding cycle. However, this movement of piston 102 occurs as part of each cycle whether or not a beam 4 has been drawn into the interior of lower plate 24. Whether a beam has actually been drawn into the lower plate in the previous cycle is controlled by switches 280–287 and the particular "C sequence" in which the apparatus is, as will be described below. As the retraction of piston 102 is completed, limit switch 302 is closed. Since T1 is also closed, this causes power to pass through line 304 to relay 290 to index the drum switch 200 one step forward to step 2. If desired, beam insertion can be accomplished in step 2 rather than step 1. This would necessitate an appropriate change in the D7 and D9 tab settings on drum selector switch 200 (see FIG. 15).

In step 2, contacts are closed for D1, D2, D6 and D12. With D1 closed, top plate 22 remains in the vertical position (as it will through step 8). Closing of D2 with switch 306 in the "automatic" position operates the actuator of hydraulic cylinder 308 which causes lower plate 24 to be moved downward vertically as shown in FIG. 9D. When lower plate 24 begins its vertical descent it opens limit switch 336, and when it reaches its lower limit of vertical travel, limit switch 310 is closed causing drum sequence relay 290 to index drum switch 200 one step forward to step 3.

Step 3 is a "skip" step, as is step 11. This is necessary in the circuitry as shown because the commercial drum switch 200 utilized has twelve D contacts rather than only the ten which are needed for the present operation, as ten contact switches of this type are not commercially available. Provision of the extra two D contacts permits incorporation of two additional operations if such would be desired. Therefore, in step 3, contacts D1, D2, D12 and T3 are closed and D6 is opened. Closing of contacts D2 (through step 5) causes lower plate 24 to remain in its lowermost position. Closing of contacts T3 allows relay 290 to index drum switch 200 forward one step to step 4.

In step 4 all D contacts are as they were in step 3, except that contacts D4 are now closed. Closing of contacts D4 with switch 316 in the "automatic" position causes operation of rotary actuator 318 to rotate bottom plate 24 90° clockwise as shown in FIGS. 9D and 9E. When bottom plate 24 begins its rotation it opens limit switch 340 and when it reaches the end of its rotation, limit switch 320 is closed causing power to flow to relay 290 which indexes drum switch 200 forward one unit to step 5.

In step 5, D contacts D5 and D10 are closed. This is the step in which a beam is withdrawn into the lower plate 24 if the particular "C (fold) sequence" has reached a C circuit in which the appropriate selector switch 280–287 is in the "yes" position. If the particular selector switch associated with the C circuit is in the "no" position (which is the position shown in FIG. **14*b* for all switches 280–287), power is diverted to line 334 from which it passes through line 304 and contacts T5 and D12 to activate relay 290 and index drum selector switch 200 forward to step 6**. In other words, since the particular selector switch indicates that a beam is not to be inserted on that C sequence, the circuitry instructs the apparatus to go on to the next step.

On the other hand, if the C sequence has cycled to the point where the particular C circuit involved is one in which the selector switch is in the "yes" mode, the mechanism is instructed to take a beam from the magazine and withdraw it into the lower plate 24. For instance, in the example mentioned above using a seven-fold block with beams to be inserted into the second and sixth folds, C circuits C2 and C6 have their selector switches 281 and 285 respectively set in the "yes" mode, thus causing the beam withdrawing mechanism to be activated on those two C sequence cycles. However, C circuits C1, C3, C4, C5 and C7, with their selector switches set in the "no" mode, would simply cause the mechanism to cycle forward to step 6 as explained above.

If sequences of cycles have been reached in which a "yes" mode C circuit has been reached, closing of contacts D5 activates timer 322 and actuator 330. Actuator 330 is an optional element which actuates an optional small clamp 333 which is attached to inner plate 82 which aids it in retaining hold of the beam 4 as it pulled into the lower plate 24. In many instances, this clamp 333 is not needed or used and therefore actuator 330 and its associated line 331 can be eliminated from the circuitry. Timer 322 is intended to operate in conjunction with actuator 330, but will also operate with the same time delay if the optional clamp 333 and actuator 330 are not used. The function of timer 322 is to give the clamp 333 adequate time to engage the beam before the piston mechanism 102 begins to withdraw the beam 4 from the magazine 44. After a predetermined interval of time (which is on the order of a second or less), timer 322 activates an internal relay which closes switches 324 and 326. Closing of these switches and contacts (including contacts D10) operates actuator 328 which operates hydraulic cylinder 100 to force piston rod 102 out of the cylinder thus partially withdrawing inner plate 82 from lower plate 24 and pulling the beam 4 on carriage 44 into lower plate 24 as has been described above. As the motion begins, limit switch 302 is opened. Once the inner plate 82 has been moved to its full extent, limit switch 332 is closed thus causing relay 290 to index drum switch 200 forward one unit to step 6.

In step 6, D contacts D2 and D10 are opened. Opening of contacts D2 releases the actuator which has been maintaining hydraulic cylinder 308 in its maximum downward position and allows the latter to return lower plate 24 to the upper position (FIGS. 9E and 9F). As the unit begins its upward travel, limit switch 310 is opened and as it reaches its maximum upward limit, limit switch 336 is closed; closing of limit switch 336 provides power to relay 290 to index drum switch 200 forward one unit to step 7, if splice switch 338 (whose function will be discussed below) is in its closed position, which it normally will be. Opening of contacts D10 removes power from the beam retractor 328. Since hydraulic unit 100 is not spring loaded, the piston 102, once it is extended, remains extended until reactivated in step 1 as described above.

In step 7, all D contacts are open except D1, D6 and D12. Opening of contacts D4 releases the rotating cylinder 318 which has been holding plate 24 in a horizontal position and allows lower plate 24 to rotate 90° counterclockwise to a vertical position as shown in FIGS. 9F and 9G. Opening of contacts D5 removes power from timer 322 and allows switches 324 and 326 to reopen; it also releases the power to the optional clamp 333 which (if used) is now no longer needed since the beam 4 is now resting vertically inside lower plate 24 and must be free to be moved into the next fold as part of next step 1 or 2 described above.

As lower plate 24 begins its counterclockwise movement, it opens limit switch 320 and as it completes its movement it closes limit switch 340. Since contacts T7 are also closed, closing of limit switch causes relay 290 to index drum switch 200 forward one unit to step 8.

In step 8, all D contacts are set as in step 7 except that contacts D8 are closed. Closing of contacts D8 with selector switch 342 in the "automatic" position activates hydraulic cylinder 344 which causes upper plate 22 to be withdrawn vertically as shown in FIGS. 9G and 9H. As upper plate 22 begins its upward motion it causes limit switch 346 to be opened and as it completes its upward motion it causes limit switch 348 to be closed. With contacts T8 also closed, closing of limit switch 346 causes relay 290 to index drum switch 200 forward one unit to step 9.

In step 9, contacts D1 are opened, cutting off power to rotary cylinder 296 which has been holding upper plate 22 in vertical position, thus allowing upper plate 22 to rotate 90° counterclockwise to its normal rest position (FIGS. 9H and 9I/9A). As the rotation begins, limit switch 300 is opened and limit switch 350 is closed as the rotation is completed. Closing of limit switch 350 causes relay to index drum switch 200 forward one unit to step 10.

In step 10, contacts D8 are opened cutting off power to the hydraulic unit 344 allowing upper plate 22 to move vertically back down to its lower rest position (FIGS. 9A and 9B). Beginning of the downward movement opens limit switch 348 and completion of the downward movement closes limit switch 346. Closing of limit switch 346 causes relay 290 to index drum switch 200 forward one unit to step 11.

In step 11, a "skip" step, contacts T11 are closed causing the relay 290 to index drum switch 200 forward to the "start" position. At the "start" step, contacts D6 are opened and with selector switch 272 in the continuous mode, the cycle of twelve steps repeats.

Selector switch 288 is used to differentiate between modules having seven and eight folds per block. In FIG **14*b*, the selector switch is shown in the "7" position. It will be seen that when the tab count step relay 312 reaches C sequence cycle C8 with switch 288 in the "7" mode, contacts C8 are closed and power is passed through bypass line 354 to count relay reset 352 which immediately resets tab count step relay 312 to a setting of "1" so that contacts C1 are closed and C8 opened. Operation of the reset 352 in this manner prevents the tab count step relay 312 from reaching the ninth position for contacts C9. On the other hand, if the selector switch 288 is set in the "8" mode (shown by the dashed lines), the bypass line 354 is open but the switch 288 is closed for lines 356 and 358. Tab count step relay 312 then goes through the normal count and closes contacts C8 which causes the entire unit to go through one fold-making cycle for the eighth fold. When the tab count step relay 312 is then cycled one unit forward in step 1 of the ninth cycle, the contacts 9C are closed powering reset 352 and returning tab count switch 312** to count "1" to close contacts C1.

Selector switch 338 is a "splice" switch utilized when a roll of fiber blanket is about to be depleted and it is desired to splice the leading end of the a new roll into the block. As the operator sees the old roll is about to run out, he throws splice switch 338 to its open position. When the next step 6 is reached and the mechanism has moved to a point at which lower plate 24 is horizontal, upper plate 22 is vertical and limit switch 336 has just been closed, the open switch 338 causes the mechanism to stop since no power is provided through contacts T6 to relay 290. The operator then trims off the remaining end of the old roll leaving a small portion of the end of the blanket extending along the upper surface of horizontal lower plate 24. He then takes the leading edge of the new roll and places it on top of the end of the old roll overlaping the entire horizontal portion of the old roll. He then recloses switch 338 which causes power to flow through contacts T6 to relay 290 and the cycle operation to be resumed. In step 7 as the lower plate 24 rotates counterclockwise it carries with it the end of the old roll and the overlapping beginning of the new roll, thus causing the two folds to be effectively spliced in the block.

In the "manual" mode of operation of the apparatus, contacts 354 of switch 274 are closed and contacts 356 are open. This activates line 276 rather than 278. This causes all of the operations to be powered through line 276. Selector switches 294, 306, 316 and 342 must be set in the "manual" mode. Similarly, step counter switch 360 must be operated manually to sequence relay 312 through the cycles through the individual C circuits and reset 352 to return tab count switch 312 to the "1" setting. Use of the "manual" mode allows the apparatus to be operated one step at a time so that each step can be carefully observed. In this way, jamming of the apparatus or other types of malfunctions can be readily located and identified for correction. Manual operation also allows the operation of the apparatus to be demonstrated slowly for such purposes as training operators and demonstrating the equipment to prospective buyers and/or users.

Switch 314 allows for manually controlled fold insertion or withdrawal of a beam by permitting manual operation of cylinder 100 and piston 102. Switch 314 is a spring loaded normally center-off switch. In its upper closed position, switch 314 activates line 362 which in turn operates actuator 301 to extend the piston and force the beam out of the lower plate 24. In its lower closed position, switch 314 powers line 364 which in turn operates timer 322 (and optional actuator 330 and clamp 333) to force piston 102 out of cylinder 100 and withdraw a beam into the lower plate 24.

Manual reset is obtained with pushbutton switch 298 (designated as portions 298*a* and 298*b*). Activation of this double pole normally open switch with contacts D6 closed causes activation of relay 290 which indexes drum switch 200 forward one step. Repeated pushings of switch 298 therefore causes the cycle sequence to be recycled through the remaining steps of a cycle one step at a time to the "start" step. Simultaneously, the tab count relay 352 is pulsed to cycle tab count switch 312 through the C circuit sequence. Once the "start" step has been reached, contacts D6 are opened and switch portion 298*a* is no longer effective. However, switch portion 298*b* continues to cycle the system forward through the individual C circuits with each application of the switch until the desired C circuit is reached and the apparatus can be started as described above to begin its cycle for that C circuit from the "start" step.

It will be recognized that for convenience, indicator lights can be incorporated into the various circuits to indicate such data as what fold (C circuit) is being formed at the particular moment, whether the apparatus is set to make seven- or eight-fold blocks, whether the apparatus is set to run in "manual" or "automatic" mode, when the control circuit is on, when the motor is on and what step in a cycle is presently being conducted.

It has been determined that these are commercial programmable microprocessing electronic devices which can replace all or a portion of the circuitry shown in FIGS. 14*a*-14*b*. One such commercial unit is a "microprocessor-based programmable controller" sold by Industrial Solid State Controls, Inc., under the designation "IPC 90".

What is claimed is:

1. Apparatus for the formation of modular blocks of folded fibrous materials, which comprises:

(a) means for forming sequential transverse folds opening in opposite directions in a longitudinal fibrous body;

(b) means for inserting modular block supporting members into folds in said fibrous body as said folds are being formed by said folding means;

(c) means for supplying said supporting members seriatim to said means for inserting; and (d) means for identifying, according to a predetermined pattern, those specific folds into which said supporting members are to be inserted by said inserting means and for controlling said inserting means to insert said supporting members into only those identified folds.

2. Apparatus as in claim 1 wherein said inserting means in part comprises a portion of said folding means.

3. Apparatus as in claim 1 wherein said folding means comprises a pair of opposed blades which alternately engage said fibrous body from opposite sides to form said folds.

4. Apparatus as in claim 1 wherein said inserting means comprises a first plate slidably housed between two second plates, means to move said first plate within the space between said second plates such that an open area is created within a portion of said space, means to place a supporting member into said open area, and means to move said first plate so that it reoccupies said open area, ejects said supporting member from said open area, and simultaneously inserts said supporting member into the predetermined fold.

5. Apparatus as in claim 1 wherein said sequencing means also comprises means to change the predetermined pattern of supporting member insertion.

6. Apparatus for the formation of modular blocks of folded fibrous materials, which comprises:

(a) a framework;

(b) a table portion mounted on said framework;

(c) a pair of vertically opposed blades each mounted on one side of said table portion, each of said blades mounted to said framework through mounting means which permits each blade to move vertically and to pivot on a shaft; the mounting means of the upper of said blades also permitting said upper blade to move horizontally;

(d) means for activating said opposed blades to cooperate to form alternating transverse folds in a longitudinal fibrous body, said body being supported at least in part by said table;

(e) the lower of said blades having interior means for opening and closing an area within said blade and adjacent the front edge thereof;

(f) means, which align horizontally with said lower blade when said lower blade is at its lowest vertical travel point and is pivoted into a horizontal position, for placing a supporting member into said opened area in said lower blade from a supporting member supply source; and (g) means, operably connected to said lower blade, for operating in sequence said interior means of said lower blade to close said area, thereby ejecting said supporting member and inserting it through a fold in said fibrous material according to a predetermined pattern.

7. Apparatus as in claim 6 wherein said interior means of said lower blade comprises a first plate slidably housed between two second plates.

8. Apparatus as in claim 6 or 7 wherein said means for placing a supporting member comprises a slidably mounted carriage containing means to support said supporting member and means for releasably engaging said interior means such that said carriage moves in conjunction with said interior member.

9. Apparatus as in claim 8 wherein said carriage also contains means for returning said carriage to its initial position after disengagement from said interior means.

10. Apparatus as in claim 6 wherein said sequencing means also comprises means for changing the predetermined pattern of supporting member insertion.

11. An apparatus as in claim 6 further comprising means cooperating with said table portion for permitting the formation of blocks of different thicknesses.

* * * * *